US006629570B1

(12) United States Patent
Head

(10) Patent No.: US 6,629,570 B1
(45) Date of Patent: Oct. 7, 2003

(54) METHOD OF DOWNHOLE DRILLING AND APPARATUS THEREFOR

(76) Inventor: Philip Head, 178 Brent Crescent, London, NW10 7XR (GB)

( * ) Notice: Subject to any disclaimer, the term of this patent is extended or adjusted under 35 U.S.C. 154(b) by 0 days.

(21) Appl. No.: 09/311,197

(22) Filed: May 12, 1999

(30) Foreign Application Priority Data

May 15, 1998 (GB) ..... 9810321

(51) Int. Cl.[7] ..... E21B 7/04
(52) U.S. Cl. ..... 175/61; 175/26
(58) Field of Search ..... 175/61, 26, 38, 175/95

(56) References Cited

U.S. PATENT DOCUMENTS

| | | | | | |
|---|---|---|---|---|---|
| 3,804,182 | A | * | 4/1974 | Adair et al. | 175/1 |
| 4,007,797 | A | * | 2/1977 | Jeter | 175/26 |
| 4,436,168 | A | | 3/1984 | Dismukes | |
| 4,463,814 | A | * | 8/1984 | Horstmeyer et al. | 175/45 |
| 4,492,276 | A | * | 1/1985 | Kamp | 175/61 |
| 4,676,310 | A | * | 6/1987 | Scherbatskoy et al. | 166/65.1 |
| 4,695,957 | A | | 9/1987 | Peltier | |
| 4,828,050 | A | * | 5/1989 | Hashimotor | 175/45 |
| 5,592,381 | A | | 1/1997 | Henneuse | |
| 5,679,894 | A | | 10/1997 | Kruger | |
| 5,725,061 | A | | 3/1998 | VanSteenwyk | |
| 5,738,178 | A | * | 4/1998 | Williams et al. | 175/61 |
| 6,047,784 | A | * | 4/2000 | Dorel | 175/61 |

FOREIGN PATENT DOCUMENTS

| | | |
|---|---|---|
| EP | 0357317 | 3/1990 |
| EP | 0 357 317 | 3/1990 |
| GB | 2284624 | 6/1995 |
| GB | 2286847 | 8/1995 |

* cited by examiner

*Primary Examiner*—Robert E. Pezzuto
*Assistant Examiner*—Meredith C. Petravick
(74) *Attorney, Agent, or Firm*—Herbert Dubno

(57) ABSTRACT

A downhole drilling apparatus suspended by tubing includes a drill bit driven by an electric motor powered by a cable means. The motor is mounted upon a hollow shaft which allows fluid to pass through, so that a fluid circuit along the tube and back along the annulus between the borehole and the tubing via the drill bit is established. The state of the motor, particularly its speed and torque, can be monitored, and the motor may then be regulated as a result of this data. Various sensors may be included in the drilling apparatus, and the data gathered similarly used to regulate the motor. Thrust means are included to urge the drill along the borehole. Supplementary pumps may be provided to assist the fluid flow. Both the thrust means and the pumps may be controlled by the control means.

11 Claims, 8 Drawing Sheets

METHOD OF DOWNHOLE DRILLING AND APPARATUS THEREFOR

FIELD OF THE INVENTION

The invention relates to a method of downhole drilling and apparatus therefor such as an electrically powered bottom hole assembly for use in coiled tubing drilling (CTD) applications.

BACKGROUND OF THE INVENTION

Simple CTD services are known using hydraulic motors to provide the rotational torque in the drill bit using hydraulic pressure of a suitable fluid. Whereas initial efforts at CTD were based around remedial work in an existing wellbore, the technology is now used to drill wells from surface and to sidetrack existing wells. Both overbalanced and underbalanced drilling techniques have been evaluated along with advances in directional drilling technology.

However there are significant drawbacks with the existing hydraulic motor systems. They have a very low durability, due mainly to the failure of seals and generally to the problems of transmitting high pressure over long distance in a well. Such failure requires withdrawal of the whole string from the well. Also, conventional coiled tubing drilling techniques have a limited choice of drilling mediums.

OBJECT OF THE INVENTION

It is therefore an object of the present invention to provide a method of downhole drilling and apparatus therefor which alleviates or overcomes at least some of these disadvantages.

SUMMARY OF THE INVENTION

According to the invention there is provided an apparatus for downhole drilling of wells comprising;

- a drilling unit comprising a drill bit for penetrating into a rock formation,
- a motor arranged to drive the drill bit, the motor including a hollow shaft which permits the passage of fluid therethrough,
- tubing upon which the drilling unit and motor are suspended,
- control means which monitor and control the action of the motor and/or drill bit, and
- cable means disposed along the tubing.

Preferably, the tubing is coiled tubing. Preferably the cable means is disposed within the coiled tubing. Preferably the hollow motor is a brushless DC motor providing direct control over the speed and torque of the drill bit. Preferably at least one sensor is provided between the motor and the drill bit. Preferably the sensor or sensors include a rock type sensor such as an x-ray lithography sensor.

The control means provides the required control over the motor in terms of its speed and torque to prevent stalling of the motor and to provide the most desirable rate of progress of the drilling process. The control means may be provided with direction output means to control the direction of the drilling by input to a directional drilling control means. Similarly, the control means may be provided with thrust output means to control the level of thrust of the drilling by input to a thruster control means. Preferably the thrust means include a plurality of eccentric hub type thrusters.

Also according the present invention there is provided a method of downhole drilling using an apparatus as defined above.

Mud may be pumped down the inside of the coiled tubing, through the hollow shaft of the motor, and to the bit in order to wash the cuttings away from the bit and back up the well through the annulus formed between the side of the well on the one hand and the outside of the coiled tubing and the motor on the other. Or alternatively, mud may be pumped down the annulus formed between the side of the well on the one hand and the outside of the coiled tubing and the motor on the other, and thence to the bit in order to wash the cuttings away from the bit and back up the well through the hollow shaft of the motor and the inside of the coiled tubing.

BRIEF DESCRIPTION OF THE DRAWING

Various embodiments of the invention will now be described in more detail, with reference to the accompanying drawing, given as an example and not intended to be limiting, in which.

SPECIFIC DESCRIPTION

Figure 1:
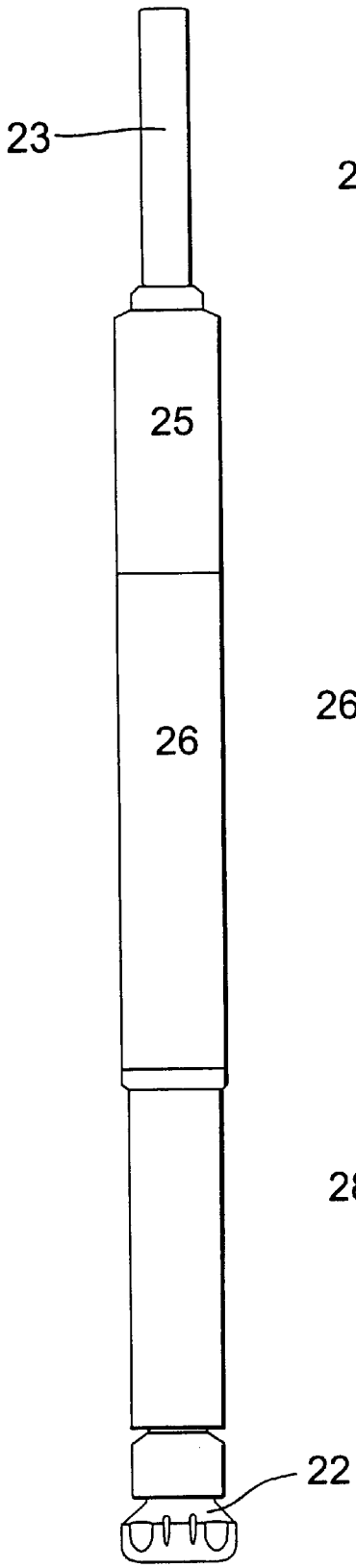
FIG. 1 is a longitudinal elevation of a bottom hole assembly.
Figure 2:
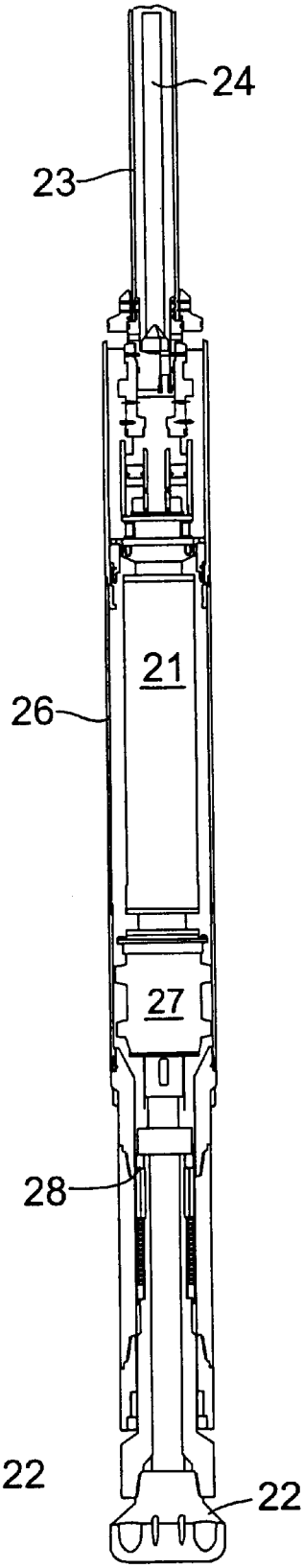
FIG. 2 is a longitudinal section of the bottom hole assembly.
Figure 4:
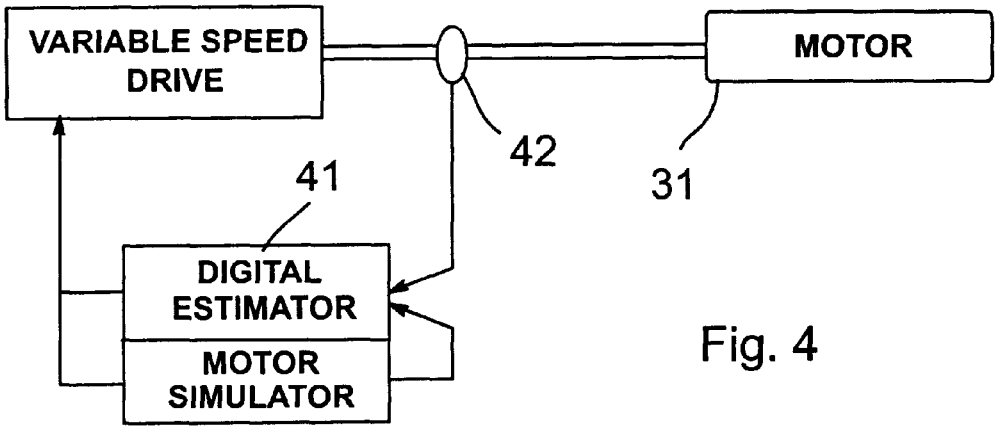
FIG. 4 is a schematic general arrangement of a control system of the motor of the assembly.

Referring FIGS. 1 and 2, for the first embodiment, an electrical motor 21 of the type used for electric submersible pumps is used. This electric motor is connected to a planetary gearbox 27 to reduce the output shaft speed to suit the drilling environment. Referring to FIG. 4, the motor is controlled from the surface by a laptop computer (not here shown) connected to a variable speed drive. A command and control software package interrogates the drive to acquire and record real-time drilling data from the motor.

In this embodiment the system provides enhanced feedback and control of drilling processes in real-time, which, when processed appropriately, will deliver relevant data to the driller and reservoir engineer. The monitoring and control aspects are discussed in greater detail later.

Referring to an alternative embodiment shown in FIGS. 3, 5 and 6, a modular design is shown which is described in more detail later. This embodiment provides a higher specific power output motor 31, and does not need a gearbox.

Customizable to a wider range of drilling environments, this promises to expand the envelope of CT drilling applications to areas such as hardrock and alternate medium drilling.

The electric coiled tubing drilling described offers several distinct advantages over conventional CTD operations. In particular, the bit speed may be maintained independent of the flow rate through the CT. The cabling provides a high quality telemetry path for an immediate data feedback, and then may be immediately controlled in response to his data. The drill bit rotation may easily be reversed, and is more reliable than conventional drilling assemblies. The drilling is suitable for underbalanced drilling applications and for the dynamic balance of circulation and formation pressures.

The embodiment of the bottom hole assembly illustrated in FIGS. 1 and 2 may be split into several distinct components. These are now discussed in more detail.

The coiled tubing connector 25 provides the electrical and mechanical connections between the power coiled tubing and the bottom hole assembly.

The connector also directs the flow of drilling fluid around the electric motor and includes a weakpoint for emergency disconnection. A standard fishing profile may be included in the design.

The motor and several parts of the bottom hole assembly must be immersed in lubricating oil for extended performance. However, during the drilling processes and under varying temperature conditions the volume of this oil will vary. Consequently a simple pressure-balanced compensation system is incorporated into the design to avoid damage from oil expansion. This system also provides a quick method of checking the overall health of the bottom hole assembly prior to running in hole. Checks on fluid levels could give an early indication of oil leakage or seal failure.

The electric motor 21 used to power the bottom hole assembly is a 15HP electrical submersible pump (ESP) induction motor. A shrouding 26 surrounds the motor, allowing the drilling fluid to be pumped through the annular space between the shrouding and the motor. This gives the bottom hole assembly an outside diameter (OD) of over 130 mm when the OD of the electric motor is only 95 mm.

A specialize gearbox 27 reduces the speed of the motor by a 7:1 ratio. The gear transmission is planetary, and typically would be rated to a maximum torque of 290 lbf-ft, though during use the measured torque may rise above this limit, but the gearbox can withstand this.

The gearbox input is connected directly to the motor output shaft via an adaptor coupling. On the output side, a flex coupling isolates the gearbox from the drive shaft. The drive shaft then passes through two sets of bearings and the mechanical seal.

Below the gearbox, a rotary seal 28 retains the oil in the motor and gearbox while the output shaft is rotating. The output shaft speed makes the use of elastomers unreliable and consequently a mechanical seal with controlled leakage is used. Typically, the seal is rated for use up to 10,000 psi differential but is designed to slowly leak for lubrication and hence have increased longevity. A bearing pack of standard type is connected to the bottom of the drive shaft.

Referring again to FIG. 4, motor power is supplied by a computer controlled variable speed drive (VSD). This type of drive is commonly used to vary the power supply of downhole pumps. A personal computer emulates the internal VSD controller, allowing identical access to commands and control functions.

The operator may monitor the bit speed and torque from the computer display. Torque is calculated from motor current and bit speed derived from VSD output frequency. A logging system is included to capture data produced during the testing period to disc. A one minute historical sample is also displayed on screen. The control elements of the VSD/laptop are deliberately kept simple to allow operation by the user. In this way, bit speed and or/torque may be quickly altered to suit the drilling environment and rapidly adapt to changes.

The drilling fluid is supplied by a portable pumping unit. Fluid enters a swivel on the side of the coiled tubing reel. Somewhat beyond the swivel connection, a lateral-piece is attached to form a tee. One side of the tee so formed is connected to the coiled tubing for the fluid path. The other side of the Tee terminates in a pressure bulkhead, with cable feedthroughs for the electric cable. Electrical power is supplied by the variable speed drive through a set of high power sliprings on the opposite side of the reel. The drilling fluid may be filtered by some conventional method and recirculated.

In use, the electric motor drive will try to maintain a constant speed once set, consequentially there will be a high degree of variation in the torque. As more or less torque is demanded of the motor, the current load will increase or decrease accordingly. As torque is directly related to current, the two fluctuate in unison. The optimum rate of penetration is obtained with a bit speed of between 300–400 rpm.

As a result of these improvements, the drilling assembly is more reliable. The drilling assembly is more flexible as the bit speed may be maintained independent of the flow rate, and reversible rotational of the bit is possible, of specific interest to traction system and certain cutting operations, such as milling out casing shoes.

There is immediate data feedback via a high quality, high data rate telemetry path providing information to the drilling engineer for geosteering and other applications. With the data from the drilling process; torque at bit, bit condition, performance drop-off evaluation for optimal ROP may all be determined The drilling assembly is suitable for a wider range of drilling technologies such as underbalanced, hard rock and alternate medium drilling, and temperatures, drilling applications, and aggressive drilling media The system incorporates the power and telemetry infrastructure upon which numerous other application can piggyback, providing a modular bottom hole assembly which is customizable to a wider range of drilling applications and environments. Ideally, integrated sensors are included in the bottom hole assembly to provide the real-time data required to make timely and informed drilling decisions. The data from the sensors may be transmitted by a cable parallel to the power cable, or the data may be superimposed upon the power line itself.

The system also offers certain advantages in terms of coil life. Primarily, fatigue is reduced as hydraulic energy is no longer required to drive the PDM. Secondly, stall-out situations can be avoided electronically, reducing the need to cycle the CT up and down each time the PDM assembly stalls.

The bottom hole assembly may be wired into surface sensors from the coiled tubing unit to be sensitive to changes in weight on bit and ROP. Feedback and control loops can be added to keep constant ROP or constant weight on bit while varying the other available drilling parameters. Downhole tools may also be added for geological determination.

It is also possible to enable integration of downhole directional sensors and geosteering capability. Thus a fully automated drilling system will be able to follow a predetermined course to locate geological targets with minimal correctional changes in direction. This would be designed to reduce doglegs and their associated problems. Such a drilling system could also be programmed to optimize ROP.

Figure 3:
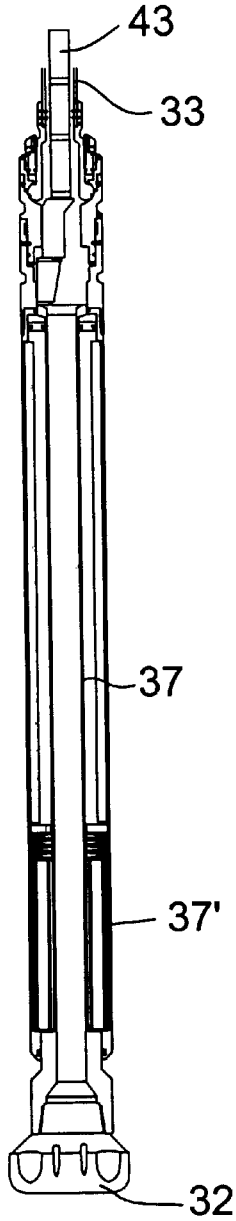
FIG. 3 is a longitudinal side elevation of a further embodiment of the bottom hole assembly.
Figure 5:
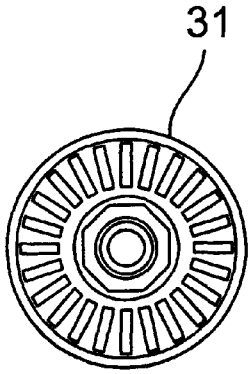
FIG. 5 is an end elevation of a further embodiment of a motor used in the assembly.
Figure 6:
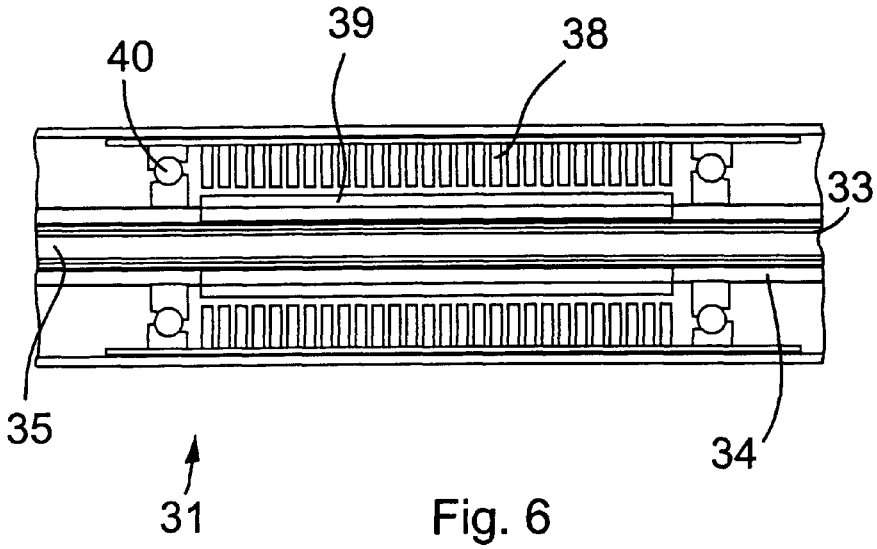
FIG. 6 is a side elevation of the further embodiment of the motor.

Referring to FIGS. 3, 5 and 6, the motor 31 includes rotor elements 38, stator elements 39 and a hollow shaft 34 which permits the passage therethrough of fluid from the inside of the coiled tubing to the drill bit 32. Mud is pumped from the surface down the inside of the coiled tubing 33 through the bore 35 of the hollow 34 shaft and to the bit 32 to wash the cuttings away from the bit and back along the well being cut on the outside of the motor and continuous coiled tubing. A liner tube 37 running through the hollow shaft ensures that the motor components are kept free of contamination, and that the need for seals within the motor is reduced.

The hollow motor is a brushless DC motor which provides direct control over the speed and torque of the drill bit 32. The rotors 38 and stators 39 of the motor are disposed in segmented sections along the hollow shaft 34, each section being separated from the next by bearings 40 supporting the hollow shaft. This arrangement allows the motor to adopt a greater curvature without the moving parts of the motor being forced to touch and damaging the motor and reducing its efficiency, since the regions between the motor sections are able to curve to a greater degree.

A sensor support 37' is provided between the motor 31 and the drill bit 32. The sensor support 37' is provided with a rock type sensor such as an x-ray lithography sensor as well as pressure and temperature sensors.

As shown in FIG. 4 control means 41 comprising a digital estimator and a motor simulator are provided for controlling the motor 31. Voltage and current input means 42 are provided to determine the speed and torque of the drill bit to the control means 41 which are preferably provided by direct electrical measurements of the motor. Preferably formation type input means are also provided to the control means from the rock type sensor 37 on sensor support 37'. Also drill bit type input means are provided to input the type of drill bit being used corresponding to the particular drilling operation. Thus power and data is provided to the motor by means of the cable 43.

The control means provides the required control over the motor in terms of its speed and torque to prevent stalling of the motor and to provide the most desirable rate of progress of the drilling process.

Figure 7:
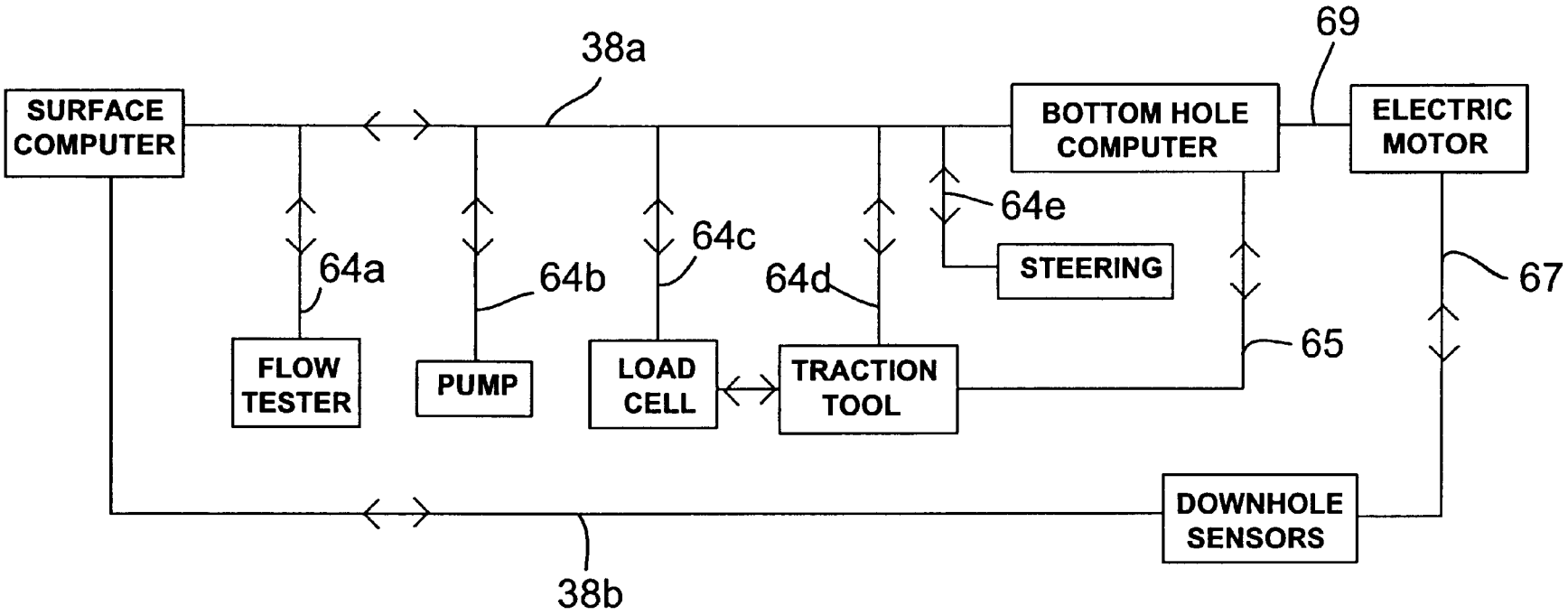
FIG. 7 is a schematic general arrangement of a control system of the invention.

FIG. 7 shows the possible interaction between some of the different components. The electric motor is directly controlled by a bottom hole computer via link 69, as well as being influenced by the downhole sensors by link 67 (which could also be fed firstly to the bottom hole computer). The bottom hole computer, and some of the downhole sensors, also monitor the motor's performance, that is, the data transfer is bidirectional.

The surface computer gathers data from the bottom hole computer transmitted along the cable 38*a*, and also directly from the downhole sensors along cable 38*b*, and also sends the drill operator's commands the bottom hole computer when the drilling is to be altered. Inline tools, such as the steering means, a traction tool and its load cell, a supplementary pump, and a flow tester are also included in the bottom hole assembly, with bidirectional communication between both the surface and bottom hole computers by cable 38*a*, and in the case of the traction tool and its load cell, between each other. Naturally, many different arrangements are possible, a particular arrangement being dependent, among other things, on the particular cable means and tools employed.

Figure 8:
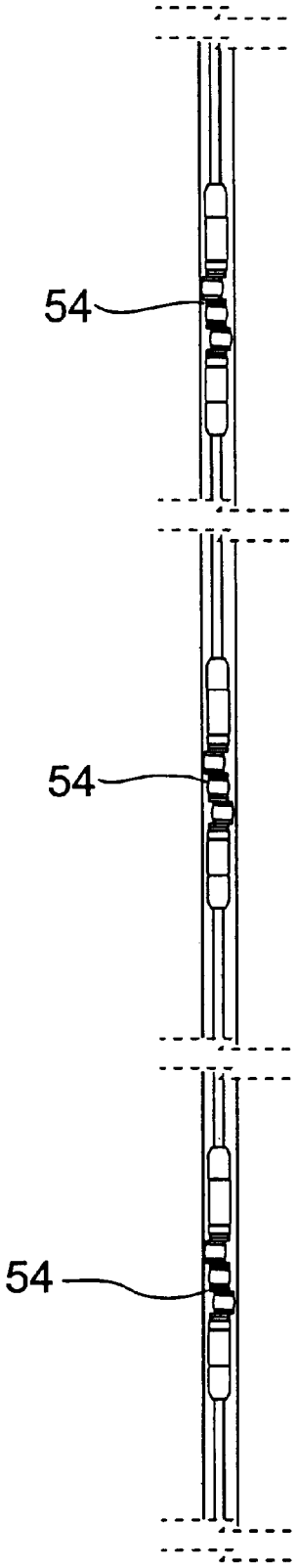
FIG. 8 is a further embodiment of the bottom hole assembly in use.
Figure 9:
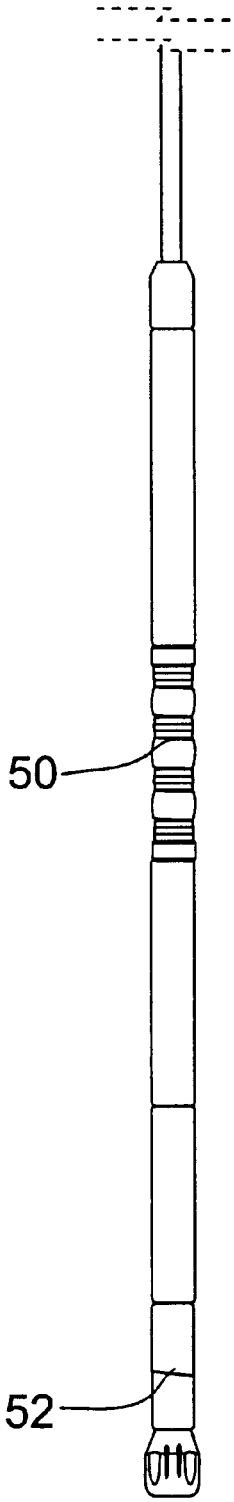
FIG. 9 is a longitudinal section of the annular pumps.
Figure 10:
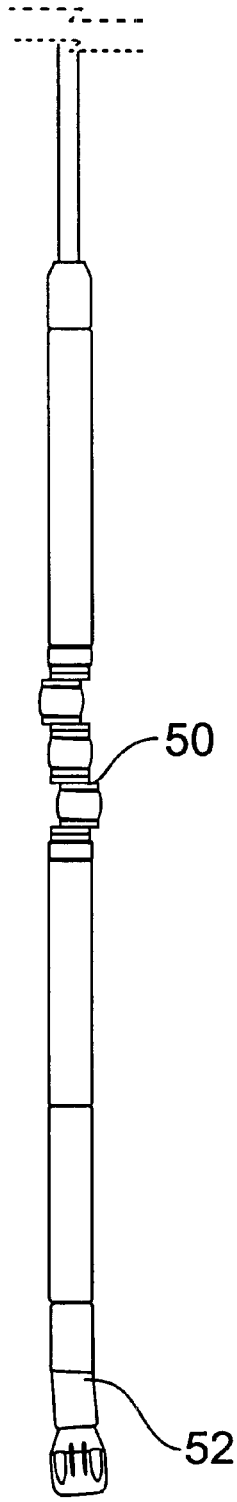
FIG. 10 is a longitudinal section of the in-line pump.

FIGS. 8 and 9 show a further embodiment of the bottom hole assembly with a thruster 50 and knuckle joint 52 provided on the bottom hole assembly. FIG. 8 shows the thruster and knuckle joint being activated, the thruster urging the drill along the borehole, and the knuckle joint causing the direction of the drill to be changed. FIG. 9 shows the thruster and knuckle joint being de-activated. The control means is provided with direction output means to control the steering of the drilling by providing the required input instructions to the knuckle joint 52. Similarly, the control means is provided with thrust output means to control the level of thrust of drilling by input to the thruster 50. The thrusters may be of the active variety, such as the eccentric hub type thrusters shown here, or thrust may be passively provided, by applying more force to the tubing at the mouth of the borehole, or a combination these means may be used by the control means to apply more weight to the bit and urge it forward, maintaining the most effective penetration rates whilst at the same time preventing stalling of the motor or failure for other reasons. Also the control means provides control over the direction of the drilling bit which enables the tool to automatically drill in the required direction, which may be changed to avoid certain rock formations or changed in response to other information of the formation which has been received during drilling. Other types of machinery or downhole tools may be included with the bottom hole assembly and similarly controlled by the control means.

Figure 11:
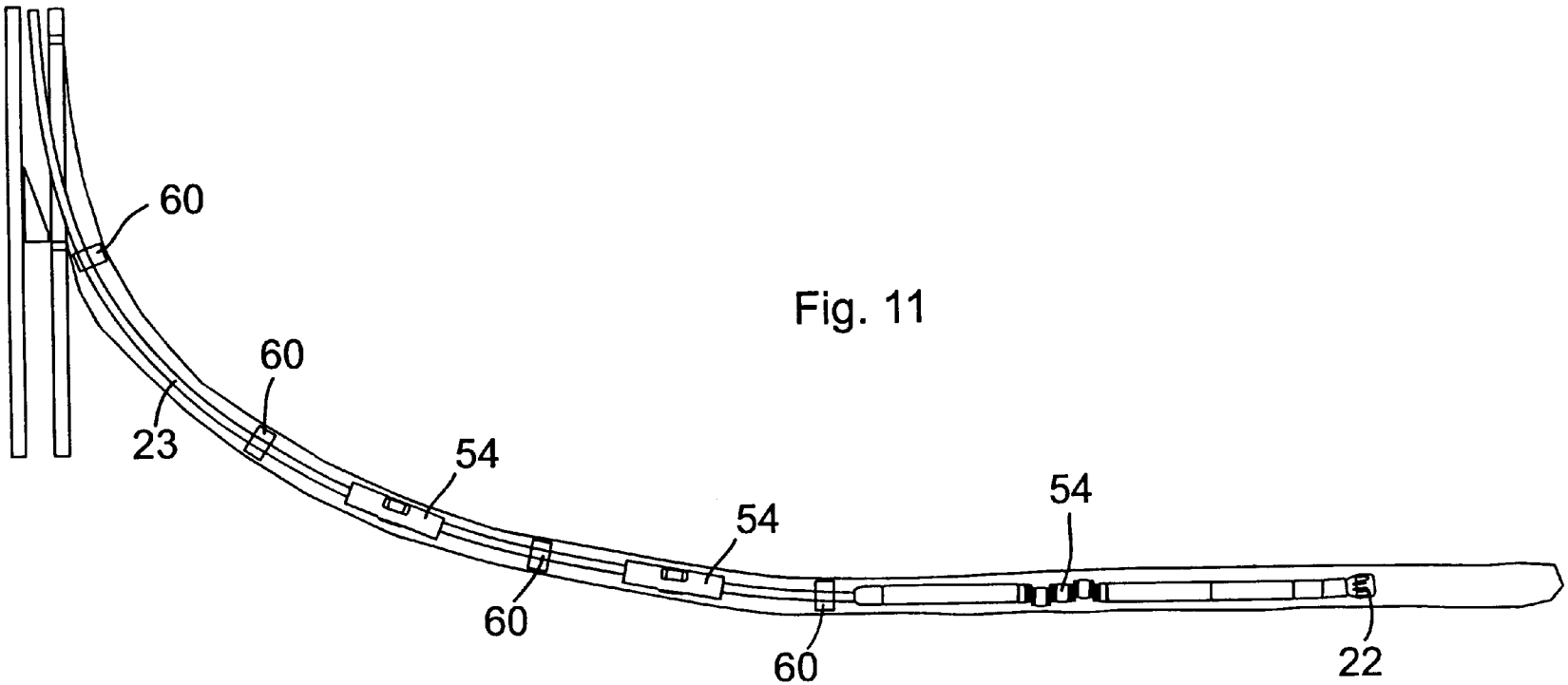
FIGS. 11, 12 and 13 are cross sections of embodiments of the cable means showing of the annular pumps.

FIG. 11 shows a general arrangement of the components of the apparatus of a further embodiment showing multiple thruster means 54 which are provided to enable horizontal drilling over long distances. This is used for example for the drilling out to sea from a land based drilling platform to avoid the expense of an off shore platform. Similarly horizontal drilling is useful from a sea based platform to reduce the need to erect additional sea based platforms. The multiple thrusters can all be controlled by the same control means so that the drilling operation can be effectively controlled along the whole length of the coiled tubing and existing problems of failure of motors and other components can be avoided and permit much longer wells to be drilled.

FIG. 11 also shows supplementary pumps 60 disposed along the coiled tubing 23 to assist the fluid flow in the well. These pumps may be disposed so as to act in the annulus between the outer diameter if the coiled tubing and the well, or in the coiled tubing. The fluid may be caused to flow into the well through the coiled tubing and thence out of the well by the annulus, or in the opposite direction, that is, into the well through the annulus and out through the coiled tubing.

Figure 12:
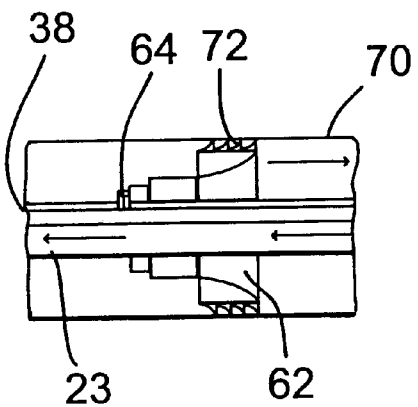

The pumps disposed so as to act in the annulus are hollow bored so that the coiled tubing may pass through the pumps. Referring to FIG. 12, the annulus pump has a hollow shaft with a motor and set of turbine blades 62 set upon it, the coiled tubing 23 passing through the shaft. The power connections 64 to the pump's motor are similar to those of the hollow motor driving the drill bit, that is, they are of the brushless DC type. Arrows are shown to indicate the possible flow pattern of fluid. Naturally, one may choose to cause the fluid to flow down the coiled tubing and to return up the annulus, or vice versa. The pump may be secured within the borehole 70 by securement means 72.

Figure 16:
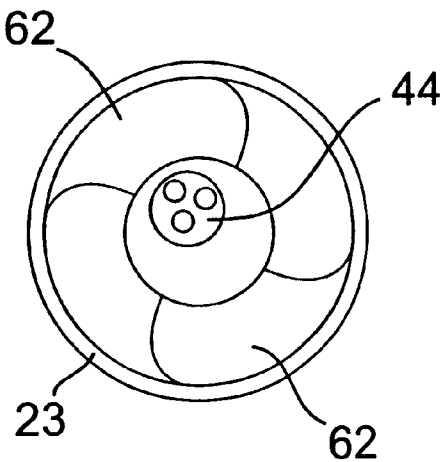
FIGS. 15 and 16 shows the thruster and directional actuation means of FIG. 14 in more detail.
Figure 15:
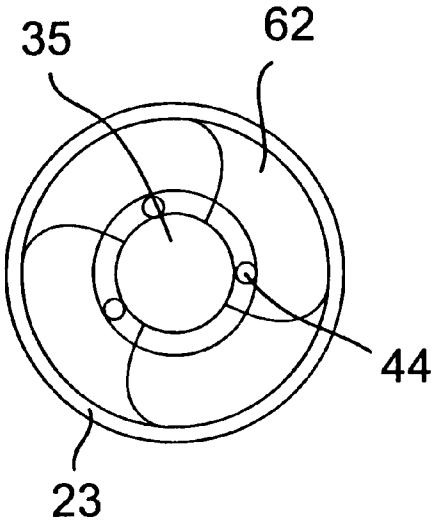
Figure 14:
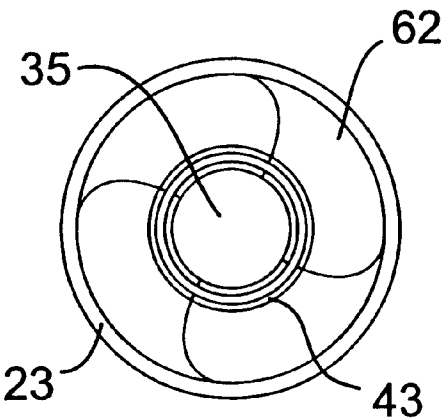
FIG. 14 is a side elevation of a further embodiment of the bottom hole assembly.

FIGS. 14 to 16 also show various arrangements of the cable means 43 disposed within the coiled tubing 23, preserving a sufficient bore 35 through the coiled tubing for fluid flow. As shown in FIG. 14, the cable 43 may be of the coaxial type concentric with the coiled tubing, or, as shown in FIGS. 15 and 16, a three strand type, either disposed in an annular steel setting 44, or set within a cable 45 running within the coiled tubing. The cable means could even be strapped to the outside of the coiled tubing.

Figure 13:
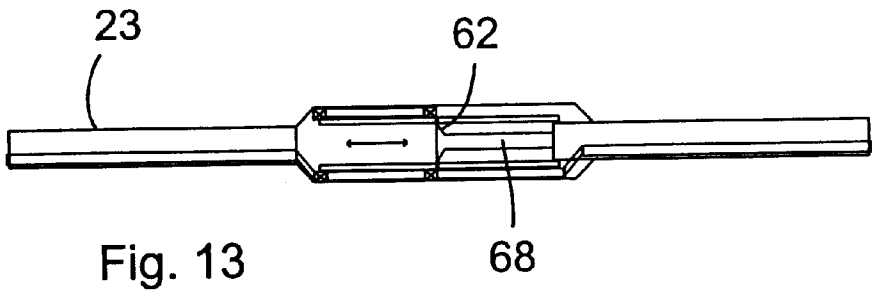

Referring to FIG. 13, the pumps 66 fitted in-line with the coiled tubing and acting on the flow within the coiled tubing 23 include turbine blades mounted conventionally upon a solid shaft 68, the shaft being caused to turn in order to turn the blades.

Figure 17:
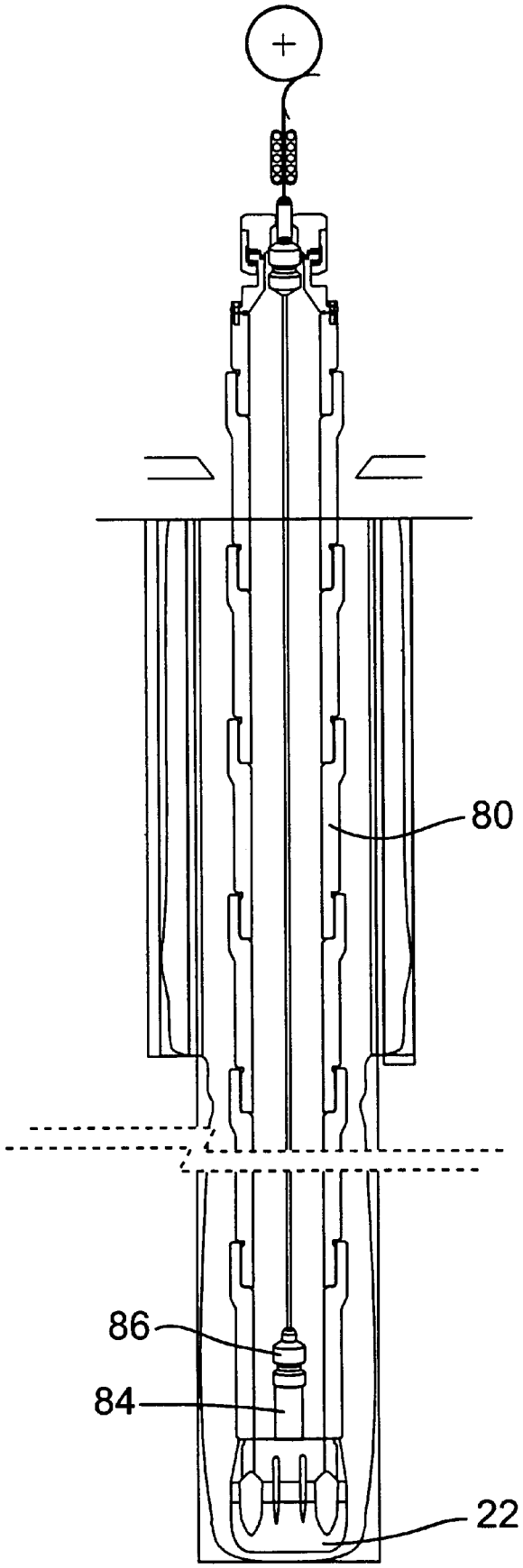
FIGS. 17 and 18 are views similar to FIGS. 2 and 4 illustrating another embodiment.

Although the principles disclosed here are eminently suited for drilling with coiled tubing, they are not so limited. Referring to FIG. 17, the techniques described above may be applied to jointed drill pipe. A drill string 80 composed of jointed sections of drill pipe terminates with a drill bit. Disposed within the drill string is a cable 82 supplying power to an electric motor 84 which drives the drill bit 22. Sensors are also included at the end of the drill string, data gathered from these being transmitted using the power cable 82. The cable is attached to the motor by a stab-in connector 86, so that the cable may be disconnected to allow further pipe sections to be added to the drill string. Fluid is then pumped down the borehole annulus to return up the drill string or vice versa, whilst the drill bit is electrically operated, being regulated by the control means in response to the relevant data collected.

Figure 18:
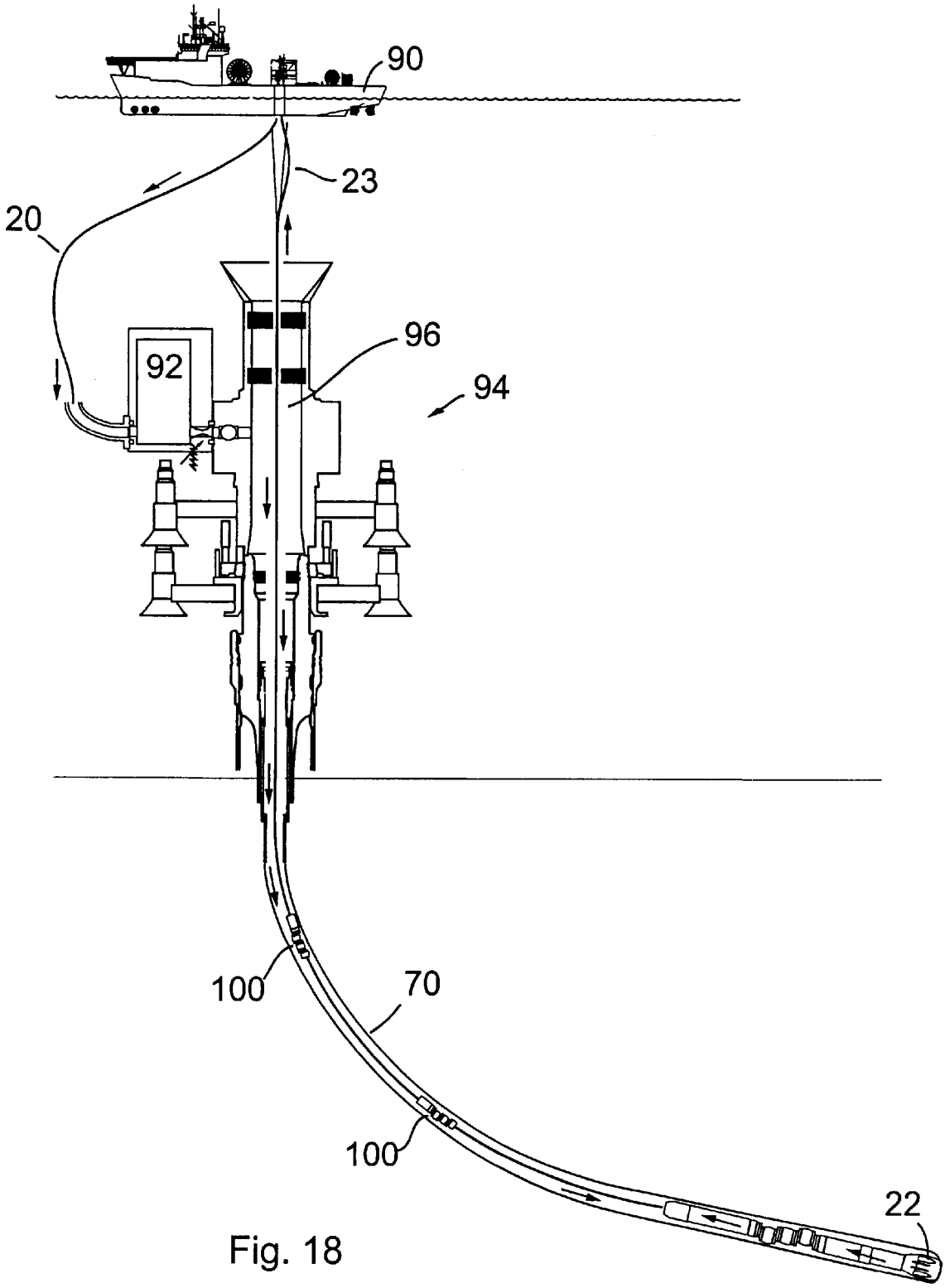

FIG. 18 shows the bottom hole assembly being deployed from a vessel 90. Fluid is pumped down a supply line 20 to a fluid accumulator 92 located upon the well head 94. The fluid is then pressurized and passes into the pressure lock chamber 96 and flows down into the borehole 70, in the annulus formed around the coiled tubing 23. The fluid passes into the drill bit 22 and thence up through the coiled tubing and back to the vessel for filtering and recirculating. The pressure lock chamber includes dynamic seals 98 which allow the coiled tubing to be fed into the borehole whilst the pressure is maintained. Pump, motor and traction units 100 aid the fluid flow as well as altering the weight on bit.

Alternative embodiments using the principles disclosed will suggest themselves to those skilled in the art, and it is intended that such alternatives are included within the scope of the invention, the scope of the invention being limited only by the claims.

What is claimed is:

1. An apparatus for downhole drilling of wells comprising:

a drilling unit comprising a drill bit for penetrating into a rock formation and optionally a gear box connected to the drill bit, an electric motor connected to said drilling unit to drive the drill bit, the motor including a hollow shaft which permits passage of a fluid therethrough, the electric motor being contained in a housing, said housing extending to immediately behind said drill bit or to said gear box, and having a diameter substantially similar to a diameter of the drill bit;

tubing upon which the drilling unit and motor are suspended for supplying said motor with drilling fluid, sensors on said tubing including monitor and drill bit monitoring sensors which monitor the action of the motor and drill bit, and directional sensors which monitor the position of the drill bit, a cable disposed along the tubing for energizing said motor and for transmitting data, a control means including a surface control computer which immediately receives data gathered by the motor and drill bit monitoring sensors and the directional sensors via the cable, and motor and drill bit control means responsive to the motor and drill bit sensors which electronically control the action of the motor and drill bit by controlling electric current supplied to said motor, and directional output means responsive to control data transmitted from the surface control computer, the surface computer detecting deviation from a predetermined course and immediately relaying correctional control data to the drill bit control means and the directional output means via the cable.

2. An apparatus according to claim 1 wherein the tubing is a length of continuous coiled tubing.

3. An apparatus according to claim 1 wherein the cable is disposed within the tubing.

4. An apparatus according to claim 1 wherein the hollow motor is a brushless DC motor providing direct control over the speed and torque of the drill bit.

5. An apparatus according to claim 1, further comprising a rock type x-ray sensor.

6. An apparatus according to claim 1 wherein speed and torque input means are provided for the control means.

7. An apparatus according to claim 6 wherein speed and torque input means use direct electrical measurements of the motor.

8. An apparatus according to claim 7 wherein the control means operates a thrust means capable of urging the drill along the well.

9. An apparatus for downhole drilling of wells comprising:

a drilling unit comprising a drill bit for penetrating into a rock formation and optionally a gear box connected to the drill bit, an electric motor connected to said drilling unit to drive the drill bit, the motor including a hollow shaft which permits passage of a fluid therethrough, the electric motor being contained in a housing, said housing extending to substantially immediately behind said drill bit or to said gear box, and having a diameter substantially similar to a diameter of the drill bit;

tubing upon which the drilling unit and motor are suspended for supplying said motor with drilling fluid, sensors on said tubing including monitor and drill bit monitoring sensors which monitor the action of the motor and drill bit, and directional sensors which monitor the position of the drill bit, a cable disposed along the tubing for energizing said motor and for transmitting data, a control means including a surface control computer which immediately receives data gathered by the motor and drill bit monitoring sensors and the directional sensors via the cable, and motor and drill bit control means responsive to the motor and drill bit sensors which electronically control the action of the motor and drill bit by controlling electric current supplied to said motor, and directional output means responsive to control data transmitted from the surface control computer, the surface computer detecting deviation from a predetermined course and immediately relaying correctional control data to the drill bit control means and the directional output means via the cable, and a pump is disposed upon the tubing.

10. An apparatus for downhole drilling of wells comprising:

a drilling unit comprising a drill bit for penetrating a rock formation and optionally a gear box connected to the drill bit, an electric motor connected to said drilling unit and arranged to drive the drill bit, the motor including a hollow shaft which permits the passage of fluids therethrough, the electric motor being contained in a housing, said housing extending to substantially immediately behind said drill bit or to said gear box, and having a constant diameter, tubing upon which the drilling unit and motor are suspended to supply said motor with drilling fluid, sensors including motor and drill bit monitoring sensors on said tubing which monitor the action of the motor and drill bit, and directional sensors on said tubing which monitor the position of the drill bit, a cable disposed along the tubing for energizing said motor and for transmitting data, and a control means including a surface control computer which immediately receives data gathered by the motor and drill bit monitoring sensors and the directional sensors via the cable, and motor and drill bit control means responsive to the motor and drill bit sensors which electronically control the action of the motor and drill bit by controlling electric current supplied to said motor, and directional output means responsive to control data transmitted from the surface control computer, the surface computer detecting deviation from a predetermined course and immediately relaying correctional control data to the drill bit control means and the directional output means via the cable.

11. An apparatus for downhole drilling of wells comprising:

a drilling unit comprising a drill bit for penetrating into a rock formation, an electric motor connected to said drilling unit and arranged to drive the drill bit, the motor including a hollow shaft which permits the passage of fluid therethrough, the electric motor comprising a rotor and stator in segments along said shaft and bearings supporting the shaft such that the motor can adopt a curvature, tubing upon which the drilling unit and motor are suspended to supply said motor with drilling fluid, sensors including motor and drill bit monitoring sensors on said tubing which monitor the action of the motor and drill bit, and directional sensors on said tubing which monitor the position of the drill bit, a cable disposed along the tubing for energizing said motor and for transmitting data, and a control means including a surface control computer which immediately receives data gathered by the motor and drill bit monitoring sensors and the directional sensors via the cable, and motor and drill bit control means responsive to the motor and drill bit sensors which electronically control the action of the motor and drill bit by controlling electric current supplied to said motor, and directional output means responsive to control data transmitted from the surface control computer, the surface computer detecting deviation from a predetermined course and immediately relaying correctional control data to the drill bit control means and the directional output means via the cable.

* * * * *